US009238899B2

(12) United States Patent
Matsumoto et al.

(10) Patent No.: US 9,238,899 B2
(45) Date of Patent: Jan. 19, 2016

(54) FRONT LOADER

(71) Applicant: KUBOTA CORPORATION, Osaka (JP)

(72) Inventors: Atsushi Matsumoto, Osaka (JP); Ryuichi Nadaoka, Osaka (JP); Masahiro Sugioka, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 0 days.

(21) Appl. No.: 14/659,991

(22) Filed: Mar. 17, 2015

(65) Prior Publication Data

US 2015/0275470 A1 Oct. 1, 2015

(30) Foreign Application Priority Data

| | | |
|---|---|---|
| Mar. 27, 2014 | (JP) | 2014-067009 |
| Mar. 31, 2014 | (JP) | 2014-072106 |
| Mar. 31, 2014 | (JP) | 2014-072107 |
| Mar. 31, 2014 | (JP) | 2014-072108 |

(51) Int. Cl.

| | |
|---|---|
| ***E02F 3/43*** | (2006.01) |
| ***E02F 9/08*** | (2006.01) |
| ***E02F 9/20*** | (2006.01) |
| ***E02F 9/24*** | (2006.01) |
| ***E02F 3/34*** | (2006.01) |

(52) U.S. Cl.

CPC ..... *E02F 3/432* (2013.01); *E02F 3/3417* (2013.01); *E02F 3/431* (2013.01); *E02F 3/433* (2013.01); *E02F 9/2037* (2013.01); *E02F 9/24* (2013.01)

(58) Field of Classification Search

CPC ..... E02F 3/432; E02F 3/3417; E02F 3/433; E02F 9/24; E02F 9/2037; E02F 3/431

USPC ..... 701/23

See application file for complete search history.

(56) References Cited

U.S. PATENT DOCUMENTS

| | | | | |
|---|---|---|---|---|
| 8,845,265 | B2 | 9/2014 | Oyama et al. | |
| 8,974,171 | B2 * | 3/2015 | Shirao | E02F 3/432 414/685 |
| 2004/0136821 | A1 | 7/2004 | Berger et al. | |
| 2005/0189168 | A1 * | 9/2005 | Bean | B66F 17/006 182/2.8 |

(Continued)

FOREIGN PATENT DOCUMENTS

| | | |
|---|---|---|
| EP | 1903147 | 3/2008 |
| JP | 07-024431 | 6/1995 |

(Continued)

OTHER PUBLICATIONS

U.S. Appl. No. 14/662,493 to Atsushi Matsumoto et al., which was filed on Mar. 19, 2015.

(Continued)

*Primary Examiner* — James Trammell
*Assistant Examiner* — Frederick Brushaber
(74) *Attorney, Agent, or Firm* — Greenblum & Bernstein, P.L.C.

(57) ABSTRACT

When maintaining a ground pivot angle of the bucket constant irrespective of any vertical pivotal movement of the boom, a ground angle maintaining controlling section stops a bucket actuator when it is detected that a vertical pivot angle of the bucket has reached an elevation restricted angle which is set smaller by a set angle than an elevation limit angle of the bucket 15 or a lowering restricted angle which is set greater by a set angle than a lowering limit angle of the bucket.

2 Claims, 4 Drawing Sheets

(56) References Cited

U.S. PATENT DOCUMENTS

| | | | | |
|---|---|---|---|---|
| 2005/0189179 | A1* | 9/2005 | Bean | B66F 17/006 187/277 |
| 2005/0241193 | A1* | 11/2005 | Burgin | E02F 3/433 37/348 |
| 2008/0313935 | A1* | 12/2008 | Trifunovic | E02F 3/432 37/413 |
| 2009/0159302 | A1* | 6/2009 | Koch | E02F 9/265 172/2 |
| 2010/0215469 | A1* | 8/2010 | Trifunovic | E02F 3/434 414/699 |
| 2010/0226744 | A1* | 9/2010 | Trifunovic | E02F 3/434 414/700 |
| 2010/0254793 | A1* | 10/2010 | Trifunovic | E02F 3/432 414/700 |
| 2011/0150614 | A1 | 6/2011 | Nicholson et al. | |
| 2012/0024146 | A1* | 2/2012 | Saito | E02F 3/431 91/525 |
| 2012/0057956 | A1* | 3/2012 | Shirao | E02F 3/432 414/707 |
| 2012/0310494 | A1* | 12/2012 | Asami | B60W 10/30 701/50 |
| 2015/0098785 | A1 | 4/2015 | Oyama et al. | |

FOREIGN PATENT DOCUMENTS

| | | |
|---|---|---|
| JP | 10-245866 | 9/1998 |
| JP | 2006-152707 | 6/2006 |
| JP | 2009-052287 | 3/2009 |

OTHER PUBLICATIONS

European Search Report in counterpart European Application No. 15160054.1, dated Sep. 10, 2015.

* cited by examiner

FRONT LOADER

TECHNICAL FIELD

The present invention relates to a front loader including a boom actuator configured to pivotally drive a boom along a vertical direction relative to a traveling vehicle body about a first pivot axis which is oriented along a right/left direction, and a bucket actuator configured to pivotally drive a bucket along the vertical direction relative to the boom about a second pivot axis which is oriented along the right/left direction.

BACKGROUND ART

As a front loader configured above, there is one having a link mechanism for maintaining a generally elevated posture of a bucket (implement) by feedback of an elevation motion of a boom from a state of the bucket being placed under the generally elevated posture, to a control valve of a bucket actuator (a tilt cylinder) (see Japanese Unexamined Patent Application Publication No. 7-24431 (Patent Document 1)).

SUMMARY OF THE INVENTION

Incidentally, in a front loader, as shown in e.g. the above-cited Patent Document 1, etc., it is commonly implemented to distribute an amount of oil from a hydraulic pump to a boom actuator (lift (elevation/lowering) cylinder) and a bucket actuator (a tilt cylinder). Therefore, in order to maintain the bucket under the elevated posture, in the course of dump-pivoting the bucket in association with an upward pivoting of the boom, if the bucket reaches a lowering limit, a main relief valve will be actuated. This may invite such inconvenience as reduction in the elevation speed of the boom and rise in the oil temperature.

The object of the present invention is to make it possible to maintain a ground pivot angle of the bucket constant, without inviting reduction in the elevation speed of the boom or rise in the oil temperature.

According to the present invention, a front loader comprises:

- a boom actuator configured to pivotally drive a boom along a vertical direction relative to a traveling vehicle body about a first pivot axis which is oriented along a right/left direction;
- a bucket actuator configured to pivotally drive a bucket along the vertical direction relative to the boom about a second pivot axis which is oriented along the right/left direction;
- a boom angle detector for detecting a vertical pivot angle of the boom;
- a bucket angle detector for detecting a vertical pivot angle of the bucket relative to the boom;
- a calculating section for calculating a ground pivot angle (i.e. pivot angle relative to the ground surface) of the bucket based on an output from the boom angle detector and an output from the bucket angle detector;
- a manual controlling section for controlling operations of the boom actuator and the bucket actuator based on an operational instruction outputted from an instruction operational tool;
- a ground angle maintaining controlling section for controlling the operation of the bucket actuator based on an output from the calculating section such that a ground pivot angle of the bucket may be maintained constant irrespective of any vertical pivotal movement of the boom;

- a storage section storing an elevation restricted angle which is set smaller by a set angle than an elevation limit angle of the bucket and a lowering restricted angle which is set greater by a set angle than a lowering limit angle of the bucket; and
- the ground angle maintaining section being configured to stop the bucket actuator when it is detected based on an output from the bucket angle detector, the elevation restricted angle and the lowering restricted angle, that a vertical pivot angle of the bucket has reached the elevation restricted angle or the lowering restricted angle.

With the above-described solution, under a condition of the ground pivot angle of the bucket being maintained constant, if the vertical pivot angle of the bucket has reached the elevation restricted angle or the lowering restricted angle, the ground angle maintaining section stops the bucket actuator. Therefore, it is possible to prevent the bucket from reaching the elevation limit angle or the lowering limit angle.

With the above, it is possible to inhibit an activation of the relief valve due to the bucket reaching the elevation limit angle or the lowering limit angle. Consequently, it becomes possible to avoid reduction in the boom driving speed or rise in oil temperature due to activation of the relief valve.

Therefore, it is made possible to maintain a ground pivot angle of the bucket constant, without inviting reduction in the elevation speed of the boom or rise in the oil temperature.

According to one solution for rendering the present invention more advantageous:

- the ground angle maintaining controlling section is configured to reduce an operational speed of the bucket actuator when it is detected based on an output from the bucket angle detector, the elevation restricted angle and the lowering restricted angle, that a vertical pivot angle of the bucket has reached a reduced speed angle which is set smaller by a set angle than the elevation restricted angle or the lowering restricted angle.

With the above-described solution, it becomes possible to reduce the operational speed of the bucket actuator before this bucket actuator is stopped. With this, it is possible to prevent generation of a shock at the time of stopping the bucket actuator and also to enhance the stopping precision of the bucket at the elevation restricted angle or the lowering restricted angle.

In the above-described configuration, preferably, the operational speed of the bucket actuator is progressively reduced while the vertical pivot angle of the bucket remains within a reduced speed range from the reduced speed range to the set angle. With this, sudden change in the operational speed is prevented, whereby smooth operation of the bucket is ensured.

In the above-described configuration, preferably, the operational speed of the bucket actuator is reduced by a duty control on the bucket actuator. With this, through the duty ratio control, the operational speed can be controlled in a reliable manner.

In the above-described configuration, preferably, the operational speed of the bucket actuator is reduced by a duty ratio control on an electric control valve for controlling supply of fluid oil to the bucket actuator. With this, through the duty ratio control, the operational speed can be controlled in a reliable manner for the bucket actuator configured as a hydraulic type.

In the above-described configuration, preferably, after passage through the reduced speed range, the operational speed of the bucket actuator is maintained to a target speed after speed reduction. With this, the stopping precision of the bucket at the elevation restricted angle or the lowering restricted angle.

In the above-described configuration, preferably, the target speed is set to a speed at which generation of a shock at the time of stop of the bucket actuator can be restricted. With this, at the elevation restricted angle or the lowering restricted angle, the bucket actuator can be stopped smoothly.

In the above, the instruction operational tool comprises an operational lever. Preferably, the operational lever comprises a cross-pivoting operational lever. The operational lever can comprise a neutral-return type operational lever. Further, the instruction operational tool comprises a lever operation detector for detecting an operated position of the operational lever. Preferably, the lever operation detector comprise a plurality of switches for detecting pivotal operations of the operational lever to respective operational positions of the operational lever. Alternatively, the lever operation detector can comprise a rotary potentiometer. Preferably, the lever operation detector comprises a rotary potentiometer for detecting a pivotal operation in a front/rear direction and a rotary potentiometer for detecting a pivotal operation in the right/left direction.

MODES OF EMBODYING THE INVENTION

Next, as an exemplary implementation of the present invention, a front loader relating to the present invention will be described with reference to the accompanying drawings by way of an embodiment wherein the front loader is mounted to a tractor as an example of a traveling vehicle body.

Figure 1:
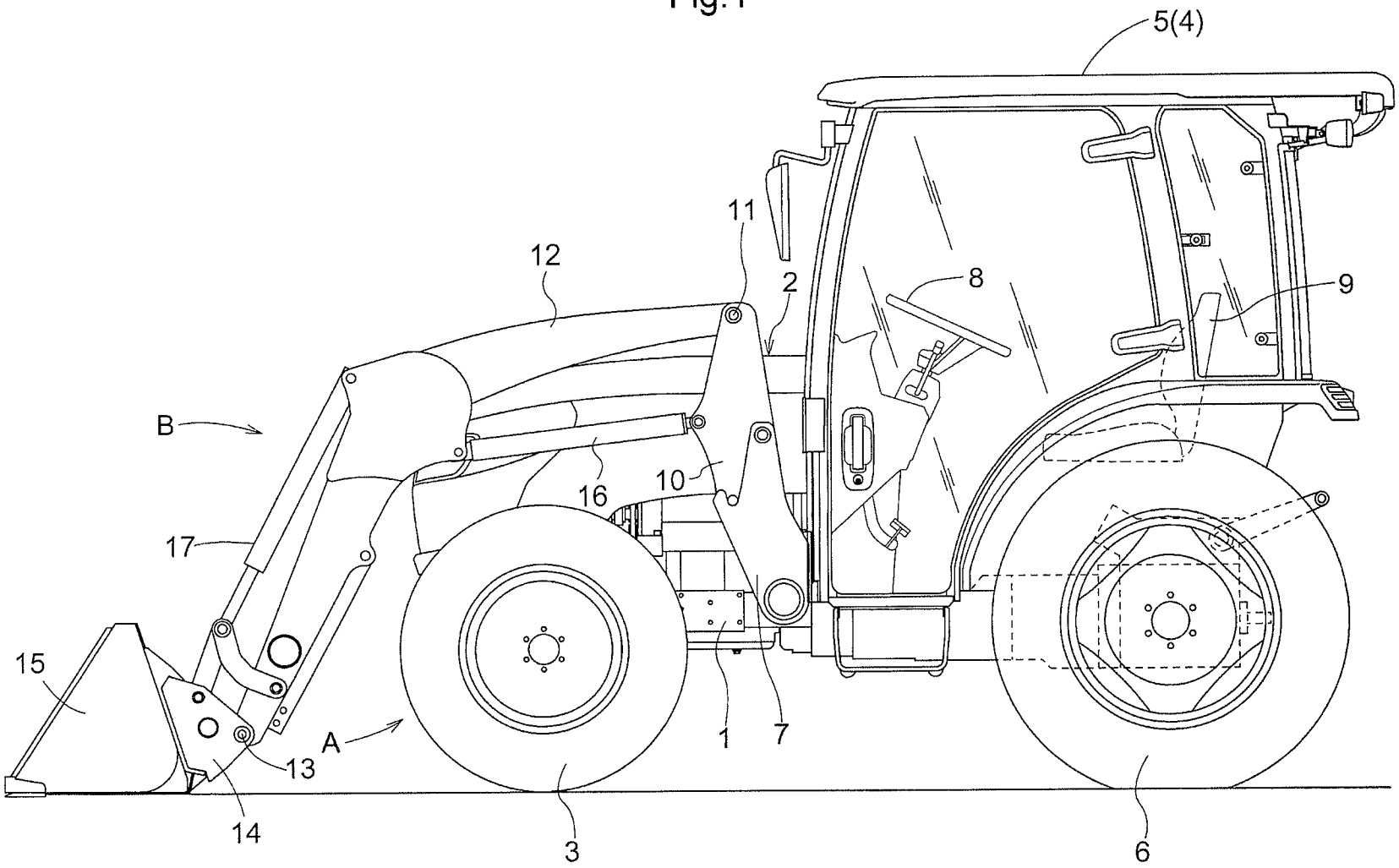
[FIG. 1] is a left side view of a tractor mounting a front loader.

As shown in FIG. 1, a tractor A as an example of a traveling vehicle body in this embodiment includes, on the front side of a vehicle body frame 1, an engine section 2 and right and left front wheels 3, etc. The tractor A also includes, on the rear side of the vehicle body frame 1, a cabin 5 forming a riding driver's section 4 and right and left rear wheels 6, etc. At a front/rear intermediate portion of the vehicle body frame 1, there are mounted right and left support brackets 7 allowing mounting of a front loader B. The riding driver's section 4 includes a steering wheel 8, a driver's seat 9, etc.

Figure 2:
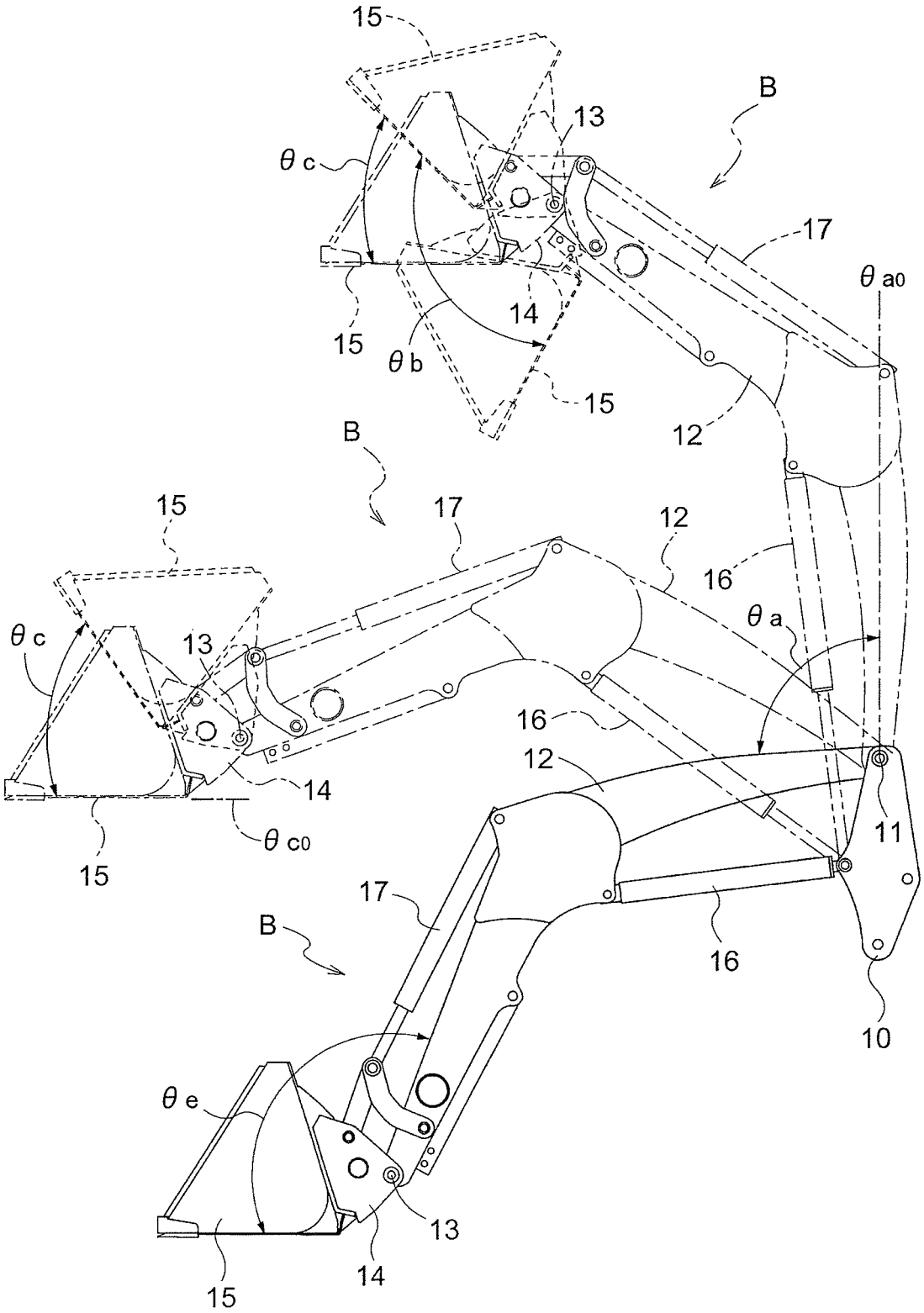
[FIG. 2] is a left side view showing an operative condition of the front loader.
Figure 3:
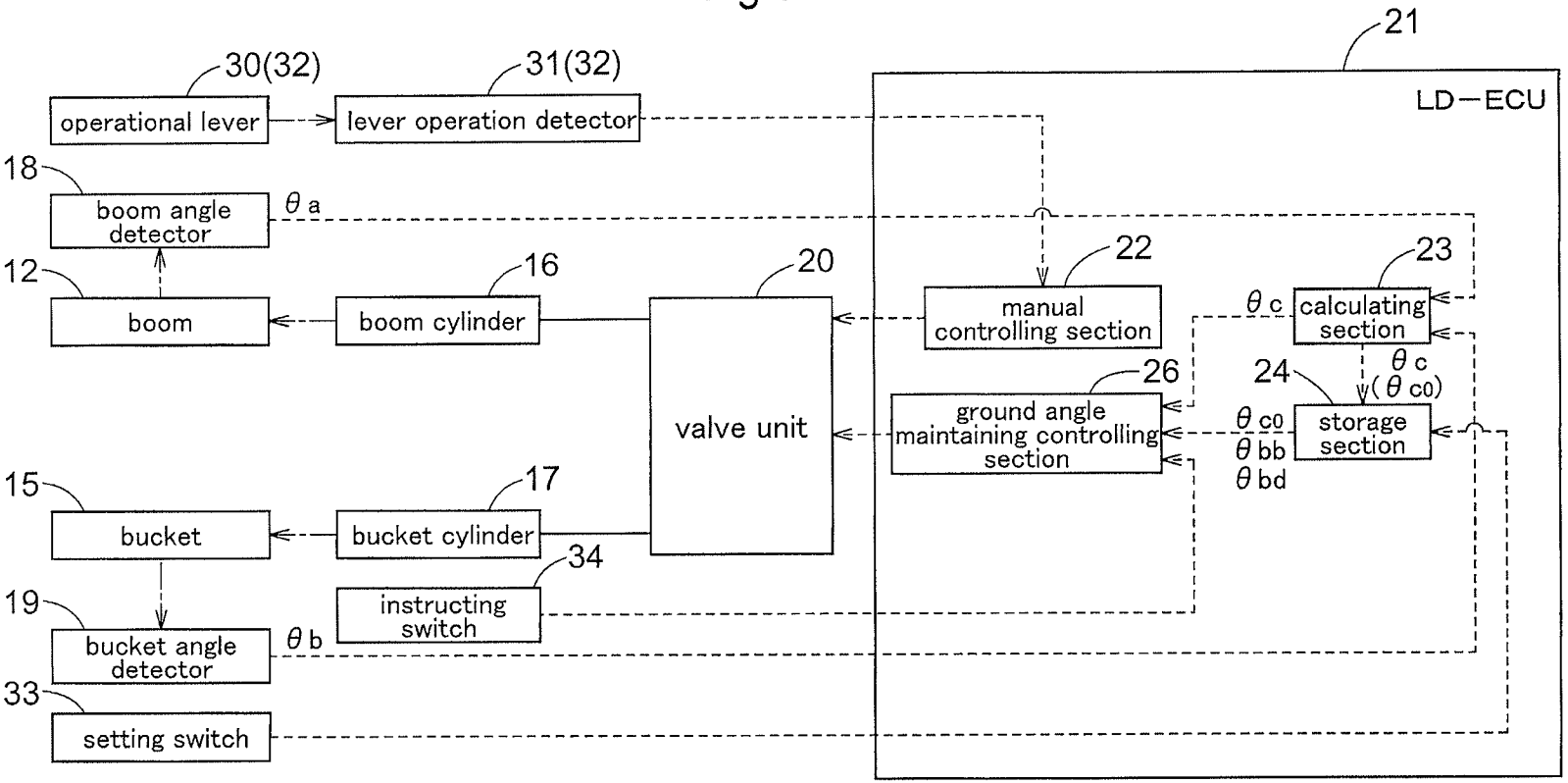
[FIG. 3] is a block diagram showing a controlling configuration relating to the front loader.

As shown in FIGS. 1 through 3, the front loader B includes right and left fixed brackets 10 detachably mounted on corresponding support brackets 7, right and left booms 12 vertically pivotally connected to the corresponding fixed brackets 10 via a first support shaft 11 which is oriented in the right/left direction, right and left pivot brackets 14 vertically pivotally connected to free ends of the corresponding booms 12 via a second support shaft 13 which is oriented in the right/left direction, a bucket 15 detachably attached to the right and left pivot brackets 4, hydraulic double-action type right and left boom cylinders 16 used as "boom actuators", hydraulic double-action type right and left bucket cylinders 17 used as "bucket actuators", a boom angle detector 18 for detecting a vertical pivot angle (θa) of one of the right and left booms 12, a bucket angle detector 19 for detecting a vertical pivot angle (θb) of the bucket 15 relative to the right and left booms 12, and so on.

The right and left boom cylinders 16 pivotally drive the corresponding booms 12 in the vertical direction about the first support shaft 11 relative to the tractor A. The right and left bucket cylinders 17 pivotally drive the bucket 15 together with the right and left pivot brackets 14 in the vertical direction about the second support shaft 13 relative to the respective booms 12. The boom angle detector 18 and the bucket angle detector 19 comprise rotary type potentiometers in this implementation.

As shown in FIG. 3, the tractor A includes a valve unit 20 for controlling flow of oil to the right and left boom cylinders 16 and the right and left bucket cylinders 17 and an electronic control unit ("LD-ECU" hereinafter) 21 for the front loader configured to control operations of the right and left boom cylinders 16 and the right and left bucket cylinders 17 via the valve control unit 20.

Though not shown, the hydraulic control unit (valve unit) 20 includes an electronic control valve for the boom configured to control flow of oil fed to the right and left boom cylinders 16, an electronic control valve for the bucket configured to control flow of oil fed to the right and left bucket cylinders 17, etc.

As shown in FIG. 2 and FIG. 3, the LD-ECU 21 comprises a microcomputer having such components as a CPU, an EEPROM, etc. And, this LD-ECU 21 includes a manual controlling section 22 enabling manual operations of the right and left booms 12 and the bucket 15, a calculating section 23 for effecting various calculations, a storage section 24 for storing various kinds of data, and a ground angle maintaining controlling section 26 for effecting ground angle maintaining control for maintaining a ground pivot angle (θc) of the bucket 15 constant, and so on.

The manual controlling section 22 effects a manual operation control for controlling operations of the right and left boom cylinders 16 and the right and left bucket cylinders 17, in response to an operational instruction outputted from an instruction operational tool 32 for operating the front loader, comprised of a cross-pivoting, neutral-return type operational lever 30 provided in the riding driver's section 4 for operating the front loader and a lever operation detector 31 for detecting an operated position of the operational lever 30.

In the manual operation control, if an operational instruction outputted from the instruction operational tool 32 is an operational instruction for boom elevation, during continuation of the output of this operational instruction, the right and left boom cylinders 16 are extended to pivot the right and left booms 12 upwards. Whereas, if the operational instruction outputted from the instruction operational tool 32 is an operational instruction for boom lowering, during continuation of the output of this operational instruction, the right and left boom cylinders 16 are contracted to pivot the right and left booms 12 downwards. Further, if the operational instruction outputted from the instruction operational tool 32 is an operational instruction for bucket elevation, during continuation of the output of this operational instruction, the right and left bucket cylinders 17 are contracted to pivot the bucket 15 upwards (scooping pivot movement). Whereas, if the operational instruction outputted from the instruction operational tool 32 is an operational instruction for bucket lowering, during continuation of the output of this operational instruction, the right and left bucket cylinders 17 are extended to pivot the bucket 15 downwards (dumping pivot movement). Moreover, if output of any operational instruction from the instruction operational tool 32 is stopped, during continuation of this stop of output, extending operations of the right and left boom cylinders 16 and the right and left bucket cylinders 17 are stopped in order to stop any vertical pivotal movements of the right and left booms 12 and the bucket 15.

The lever operation detector 31 can employ e.g. a plurality of switches for detecting the pivotal operations of the operational lever 30 to the various operated positions, or a rotary potentiometer for detecting a pivotal operation of the operational lever 30 in the front/rear direction in combination with a further rotary potentiometer for detecting a pivotal operation of the operational lever 30 in the right/left direction.

The calculating section 23 calculates a ground pivot angle (θc) of the bucket 15 based on an output from the boom angle detector 18 and an output from the bucket angle detector 19 and then outputs this calculation result to the storage section 24, the ground angle maintaining controlling section 26, etc.

The storage section 24 stores the ground pivot angle (θc) of the bucket 15 outputted from the calculating section 23 as a control target angle (θico) if a setting switch 33 for setting control target angle provided in the riding driver's section 4 was depressed. More particularly, if the operational lever 30 was operated to actuate the right and left boom cylinders 16 and the right and left bucket cylinders 17 to operate the bucket 15 to a desired ground pivot angle (θc) and then the setting switch 33 was depressed, this ground pivot angle (θc) of the bucket 15 can be stored as a control target angle (θco) for ground angle maintaining control in the storage section 24. Meanwhile, FIG. 2 illustrates a condition wherein the control target angle (θco) for ground angle maintaining control is set to an angle for placing the bottom face of the bucket 15 horizontal.

Further, there are also stored elevation restricted angles (θbb) set slightly smaller, by a set angle (e.g. 2 degrees) than elevation limit angles (θba) of the bucket 15 and lowering restricted angles (θbd) set greater, by a set angle (e.g. 2 degrees) than lowering limit angles (θbc) of the bucket 15.

Figure 4:
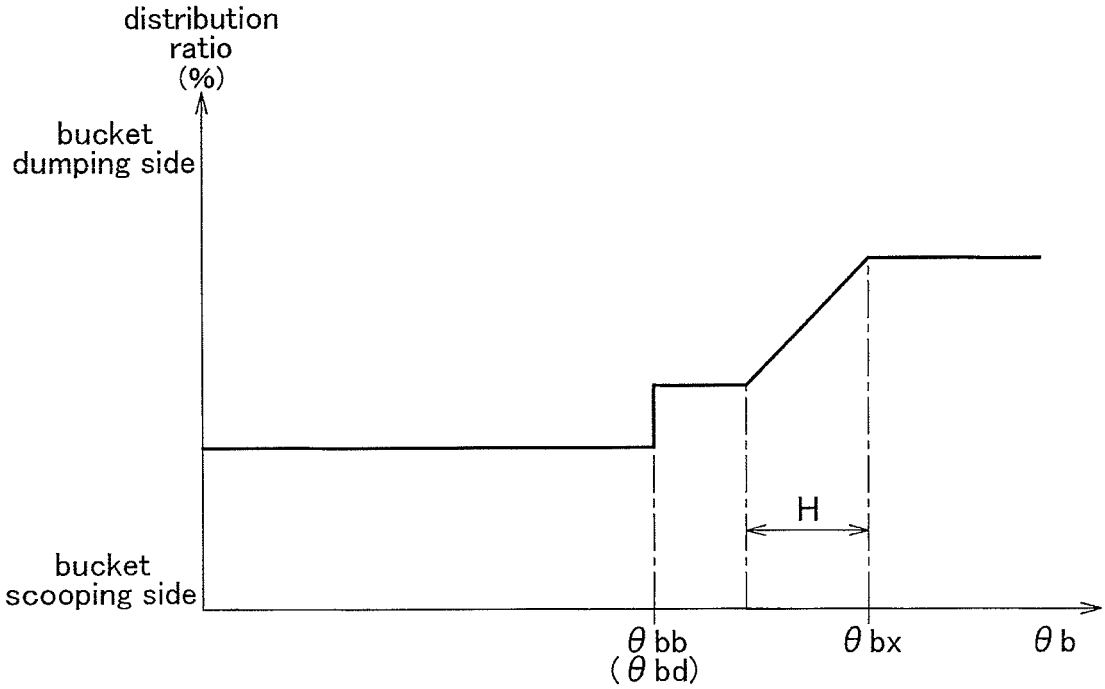
[FIG. 4] is a view showing operational speeds at the time of automatic stop of bucket.

As shown in FIGS. 2 through 4, the ground angle maintaining controlling section 26 effects ground angle maintaining control in case an instruction switch 34 for ground angle maintaining control provided in the riding driver's section 4 is depressed during stop of execution of the ground angle maintaining control. Also, this ground angle maintaining control is terminated if the instruction switch 34 for ground angle maintaining control is depressed during execution of ground angle maintaining control.

In the ground angle maintaining control, firstly, based on an output from the boom angle detector 18, determination is made whether the vertical pivot angle (θa) of the right and left booms 12 under stopped state thereof is within a set angle range (e.g. 2 degrees) from the elevation limit angles (θao) of the right and left booms 12 or not.

Thereafter, when the instruction operational tool 32 outputs a boom lowering operational instruction, irrespectively of the result of the above determination, before the manual controlling section 22 initiates a lowering control operation for the right and left boom cylinders 16 based on the above operational instruction, an elevation control operation for the right and left bucket cylinders 17 is initiated. And, based on the control target angle (θco) for ground angle control stored in the storage section 24 and the ground pivot angle (θc) of the bucket 15 outputted from the calculating section 23, operations of the right and left bucket cylinders 17 are controlled such that the ground pivot angle (θc) of the bucket 15 may agree to the control target angle (θco) for the ground angle control (be present within a non-sensitive range of the control target angle (θco)), irrespective of lowering pivotal movement of the right and left booms 12.

Conversely, when the instruction operational tool 32 outputs a boom elevation operational instruction, the result of the above determination is reflected and if the determination result indicates the angle being outside the set angle range, then, based on this operational instruction, lowering control operation for the right and left bucket cylinders 17 will be initiated before the manual controlling section 22 initiates elevation controlling operation for the right and left boom cylinders 16 based on the above operational instruction.

Moreover, if the determination result indicates the angle being within the set angle range, then, no control operation for the right and left bucket cylinders 17 is effected and the bucket 15 is maintained under its current pivotal posture.

Namely, when the instruction operational tool 32 outputs a boom lowering operational instruction and also when the instruction operational tool 32 outputs a boom elevation operational instruction in the case of the vertical pivot angle (θa) of the right and left booms 12 under stopped state thereof being outside the set angle from the elevation limit angles (θao) of the right and left booms 12, through combination of feedforward control and feedback control, the ground pivot angle (θc) of the bucket 15 can be maintained at the the control target angle (θco) for the ground angle maintaining control (a desired ground pivot angle) with high precision, without inviting control delay for the right and left bucket cylinders 17.

Further, when the instruction operational tool 32 outputs a boom elevation operational instruction in the case of the vertical pivot angle (θa) of the right and left booms 12 under stopped state thereof being within the set angle from the elevation limit angles (θao) of the right and left booms 12, by not effecting any feedforward control, it is possible to avoid occurrence of inconvenience of the ground pivot angle (θc) of the bucket 15 deviating significantly from the control target angle (θco) for the ground angle maintaining control, due to preceding lowering pivotal movement of the bucket 15 in spite of the inability of the right and left booms 12 to pivotally move upwards.

With the ground angle controlling section 26, in the ground angle maintaining control, in addition to the above-described control operations, based on an output from the bucket angle detector 18 and the elevation restricted angle (θbb) and the lowering restricted angle (θbd) both stored at the storage section 24, if it is detected that the vertical pivot angle (θb) of the bucket 15 has reached a reduced speed angle (θbx) set prior by a set angle (e.g. 10 degrees) to the elevation restricted angle (θbb) or the lowering restricted angle (θbd); then, on priority over the control operation of the manual controlling section 22 based on an operational instruction from the instruction operating tool 32, a duty ratio for the electronic control valve for the bucket is changed so as to progressively decrease an oil distribution ratio for the right and left bucket cylinders 17 while the bucket 15 remains within a reduced speed range (H) from the reduced speed angle (θbx) to the set angle (e.g. 5 degrees), thus progressively reducing the operational speed of the right and left bucket cylinders 17 to a target speed. Then, after passage through the reduced speed range (H), the operational speed will be maintained at the target speed.

Thereafter, when it is detected that the vertical pivot angle (θb) of the bucket 15 has reached the elevation restricted angle (θbb) or the lowering restricted angle (θbd); then, the right and left bucket cylinders 17 will be automatically stopped, whereby the vertical pivot angle (θb) of the bucket 15 will be maintained at the elevation restricted angle (θbb) or the lowering restricted angle (θbd).

With the above-described arrangement, in the ground angle maintaining control, it is possible to avoid occurrence of inconvenience of a relief valve provided in the valve unit 20 being activated to reduce the amount of oil fed to the right and left boom cylinders 16, thus inadvertently reducing the driving speed of the booms 12, due to the vertical pivot angle (θb) of the bucket 15 reaching the elevation restricted angle (θbb) or the lowering restricted angle (θbc).

Moreover, as the operational speed of the right and left bucket cylinders 17 is progressively reduced prior to the automatic stop, it is possible to restrict occurrence of shock at the time of automatic stop, thus allowing increase in stopping precision of the bucket at the the elevation restricted angle (θbb) or the lowering restricted angle (θbd).

Though not shown, the storage section 24 may be configured to store relation data representing relation among the vertical pivot angles (θa) of the booms 12, the elevation restricted angles (θcb) set smaller, by a set angle than the elevation limit angles (θca) of the bucket 15 relative to the ground pivot angles (θc) of the bucket 15, and the lowering restricted angles (θbd) set larger, by a set angle than the lowering limit angles (θcc) of the bucket 15. And, a setting section may be provided for setting the elevation restricted angle (θcb) and the lowering restricted angle (θbd) of the bucket 15 in accordance with the vertical pivot angle (θa) of the booms 12, based on such relation data and an output from the boom angle detector 18. And, when the ground angle maintaining controlling section 26 detects that the vertical pivot angle (θc) of the bucket 15 has reached the elevation restricted angle (θcb) or the lowering restricted angle (θcd), the right and left bucket cylinders 17 may be stopped automatically.

OTHER EMBODIMENTS

The traveling vehicle body A can be a vehicle dedicated to loader operations, a loader-mower vehicle mounting the front loader B and a mower, a loader-excavator vehicle mounting the front loader B and a backhoe.

The boom actuator 16 and the bucket actuator 17 can be hydraulic motors or the like.

The instruction operational tool 32 can comprise an operational tool for the boom only and a further operational tool for the bucket only. Further, the instruction operational tool 30 can comprise a switch for instructing an upward pivot movement of the boom 12 a switch for instructing a downward pivot movement of the boom 12, a switch for instructing a scooping pivot movement of the bucket 15 and a switch for instructing a dumping pivot movement of the bucket 15.

The boom angle detector 18 can comprise a sliding type potentiometer configured to detect an extended/contracted length of the boom cylinder 16 as a vertical pivot angle (θa) of the boom 12. Further, the bucket angle detector 19 can comprise a sliding type potentiometer configured to detect an extended/contracted length of the bucket cylinder 17 as a vertical pivot angle (θb) of the bucket 15.

The set angle of the elevation restricted angle (θbb) of the bucket 15 from the elevation limit angle (θba) and the set angle of the bucket 15 from the lowering restricted angle (θbd) from the lowering limit angle (θbc) causing the ground angle maintaining controlling section 26 to stop the bucket actuator 17 can vary in many ways as long as no inconvenience occurs in maintaining the ground pivot angle (θc) of the bucket 15 constant. For instance, the set angles can be 3 degrees, 4 degrees, etc.

The reduced speed angle (θbx) can vary in many ways. For instance, this can be an angle smaller/greater by 5 degrees or 15 degrees than the elevation restricted angle (θab) or the lowering restricted angle (θbd) of the bucket 15.

The present invention is applicable to a front loader to be mounted on a traveling vehicle body such as a tractor.

The invention claimed is:

1. A front loader comprising:

a boom actuator configured to pivotally drive a boom along a vertical direction relative to a traveling vehicle body about a first pivot axis which is oriented along a right/left direction;

a bucket actuator configured to pivotally drive a bucket along the vertical direction relative to the boom about a second pivot axis which is oriented along the right/left direction;

a boom angle detector for detecting a vertical pivot angle of the boom;

a bucket angle detector for detecting a vertical pivot angle of the bucket relative to the boom;

a calculating section for calculating a ground pivot angle of the bucket based on an output from the boom angle detector and an output from the bucket angle detector;

a manual controlling section for controlling operations of the boom actuator and the bucket actuator based on an operational instruction outputted from an instruction operational tool;

a ground angle maintaining controlling section for controlling the operation of the bucket actuator based on an output from the calculating section such that a ground pivot angle of the bucket may be maintained constant irrespective of any vertical pivotal movement of the boom;

a storage section storing an elevation restricted angle which is set smaller by a set angle than an elevation limit angle of the bucket and a lowering restricted angle which is set greater by a set angle than a lowering limit angle of the bucket; and the ground angle maintaining section being configured to stop the bucket actuator when it is detected based on an output from the bucket angle detector, the elevation restricted angle and the lowering restricted angle, that a vertical pivot angle of the bucket has reached the elevation restricted angle or the lowering restricted angle.

2. The front loader according to claim 1, wherein the ground angle maintaining controlling section is configured to reduce an operational speed of the bucket actuator when it is detected based on an output from the bucket angle detector, the elevation restricted angle and the lowering restricted angle, that a vertical pivot angle of the bucket has reached a reduced speed angle prior by a set angle to the elevation restricted angle or the lowering restricted angle.

* * * * *